US010301091B2

(12) United States Patent
Ramsuer et al.

(10) Patent No.: US 10,301,091 B2
(45) Date of Patent: May 28, 2019

(54) CARTON AND BLANK THEREFOR

(71) Applicant: WestRock Packaging Systems, LLC, Norcross, GA (US)

(72) Inventors: Brandon L. Ramsuer, Henrico, VA (US); Caleb S. Loftin, Richmond, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 15/539,197

(22) PCT Filed: Jan. 12, 2016

(86) PCT No.: PCT/US2016/012958
§ 371 (c)(1),
(2) Date: Jun. 23, 2017

(87) PCT Pub. No.: WO2016/115074
PCT Pub. Date: Jul. 21, 2016

(65) Prior Publication Data

US 2018/0009585 A1 Jan. 11, 2018

Related U.S. Application Data

(60) Provisional application No. 62/102,721, filed on Jan. 13, 2015.

(51) Int. Cl.
*B65D 71/36* (2006.01)

(52) U.S. Cl.
CPC ..... *B65D 71/36* (2013.01); *B65D 2571/0066* (2013.01); *B65D 2571/00141* (2013.01);
(Continued)

(58) Field of Classification Search
CPC ..... B65D 71/36; B65D 2571/00141; B65D 2571/00561; B65D 2571/0066;
(Continued)

(56) References Cited

U.S. PATENT DOCUMENTS 2,899,123 A * 8/1959 Dickstein ..... B65D 71/36 206/427
4,315,569 A 2/1982 Jaeschke
(Continued)

FOREIGN PATENT DOCUMENTS

DE 1915058 U 4/1965

*Primary Examiner* — Bryon P Gehman
(74) *Attorney, Agent, or Firm* — WestRock Intellectual Property Group

(57) ABSTRACT

A carton includes primary panels (12, 14, 16, 18) hingedly interconnected to form a tubular structure and an end closure structure (1). The primary panels include a first wall panel (12) and a second wall panel (14). The end closure structure includes a first end flap (22*b*) connected to the first wall panel and a second end flap (24*b*) connected to the second wall panel. The first end flap includes two arm portions (52, 54) each hingedly connected to the first wall panel, and a bridging portion (50) extending between the arm portions. The two arm portions are spaced apart from each other such that a display window (56) is defined between the two arm portions and that one or more containers (A) in the carton are exposed to view through the display window.

20 Claims, 6 Drawing Sheets

(52) U.S. Cl.
CPC ..... *B65D 2571/00561* (2013.01); *B65D 2571/00728* (2013.01); *B65D 2571/00845* (2013.01)

(58) Field of Classification Search
CPC ..... B65D 2571/00728; B65D 2571/00845; B65D 75/00
USPC ..... 206/427, 429, 775, 782
See application file for complete search history.

(56) References Cited

U.S. PATENT DOCUMENTS

| | | | | |
|---|---|---|---|---|
| 7,367,453 | B2 * | 5/2008 | Sutherland | B65D 71/36 206/427 |
| 9,527,642 | B2 * | 12/2016 | Ramsuer | B65D 71/36 |
| 9,868,582 | B2 * | 1/2018 | Gilpatrick | B65D 71/36 |
| 2004/0188508 | A1 | 9/2004 | Holley | |
| 2007/0158226 | A1 | 7/2007 | Coltri-Johnson | |
| 2010/0122998 | A1 | 5/2010 | Burke | |

* cited by examiner

CARTON AND BLANK THEREFOR

CROSS-REFERENCE TO RELATED APPLICATIONS

This application is a National Phase application of PCT Application PCT/US2016/012958, filed Jan. 12, 2016, which claims the benefit of U.S. Provisional Patent Application No. 62/102,721, filed Jan. 13, 2015, which is incorporated herein by reference in its entirety.

FIELD OF THE INVENTION

The present invention relates to a carton and a blank for forming the same, more specifically, but not exclusively to a carton which comprises a corner window.

BACKGROUND OF THE INVENTION

In the field of packaging, it is often required to provide consumers with a package comprising multiple primary product containers. Such multi-packs are desirable for shipping and distribution and for display of promotional information. For cost and environmental considerations, such cartons or carriers need to be formed from as little material as possible, and cause as little wastage in the materials from which they are formed as possible. Another consideration is the strength of the packaging and its suitability for holding and transporting large weights of articles.

It is desirable to display a primary product container whilst disposed within a multi-pack so as to enhance the aesthetics of the package. It is also desirable that the primary product containers are securely held within the multi-pack.

SUMMARY OF INVENTION

The present invention seeks to overcome or at least mitigate the problems of the prior art.

According to a first aspect of the present invention, there is provided a carton for packaging one or more primary product containers comprising a plurality of primary panels hingedly interconnected to form a tubular structure and an end closure structure which at least partially closes one of the opposed ends of the tubular structure, wherein the primary panels include a first wall panel and a second wall panel, the end closure structure comprises a first end flap connected to the first wall panel and a second end flap connected to the second wall panel, the first end flap comprises:

- at least two arm portions each hingedly connected at one end thereof to the first wall panel and extending to the other end thereof; and
- a bridging portion connected to the other ends of the arm portions and extending between the arm portions,
- wherein the at least two arm portions are spaced apart from each other such that a display window is defined, at least in part, between the at least two arm portions, and that a portion of at least one of the primary product containers is exposed to view through the display window, and
- wherein the bridging portion is secured to the second end flap thereby closing, at least in part, one of the opposed ends of the tubular structure.

Optionally, the bridging portion is hingedly connected to the arm portions along fold lines extending substantially parallel to a fold line between the first wall panel and at least one of the arm portions.

Preferably, the display window has a first dimension and the carton has a second dimension, the first dimension being greater than half of the second dimension.

More preferably, the first dimension is the height of the display window and the second dimension is the height of the carton.

In some embodiments the bridging portion is concealed from view behind the second end flap.

Optionally, the hinged connections between the at least two arm portions and the bridging portion are disposed internally of the second end flap so as to be concealed from view.

Alternatively, the hinged connections between the at least two arm portions and the bridging portion are aligned with a side edge of the second end flap.

In some embodiments, a portion of the bridging portion is visible alongside the second end flap.

Optionally, the hinged connections between the at least two arm portions and the bridging portion are offset, in a direction transverse to the tubular axis, with respect to a side edge of the second end flap, such that a part of the bridging portion is exposed to view.

An edge of the display window may be aligned with a side edge of the second end flap.

Optionally, a portion of the display window is overlaid by a portion of the second end flap.

In some embodiments the display window extends into the first wall panel.

An edge of the display window may be co-linear or aligned with the hinged connection between the at least two arm portions and the first wall panel.

Optionally, an edge of the display window is co-linear or aligned with the hinged connection between the at least two arm portions and the bridging portion.

In some embodiments the two arm portions define a corner of the carton.

Preferably, the two arm portions deform to at least partially follow the contour or shape of an article disposed adjacently thereto. More preferably, the two arm portions are arcuate in shape.

In some embodiments the second wall panel comprises rounded corners adjacent to at least one of the arm portions.

According to a second aspect of the present invention there is provided a blank for forming a carton comprising a plurality of panels for forming walls of a tubular structure and end flaps for at least partially closing the ends of the tubular structure, wherein one of end flaps comprises:

- two arm portions each hingedly connected at one end thereof to a first wall panel and extending to the other end thereof, the two arm portions being spaced apart from each other; and
- a bridging portion connected to the other ends of the arm portions and extending between the arm portions,
- a display window for displaying at least one article is defined at least in part between the two arm portions.

Optionally, the two arm portions define a corner of a setup carton.

Within the scope of this application, it is envisaged that the various aspects, embodiments, examples, features and alternatives set out in the preceding paragraphs, in the claims and/or in the following description and drawings, may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EXEMPLARY EMBODIMENTS OF THE PRESENT INVENTION

Detailed descriptions of specific embodiments of the package, blanks and cartons are disclosed herein. It will be understood that the disclosed embodiments are merely examples of the way in which certain aspects of the invention can be implemented, and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale, and some features may be exaggerated or minimised to show details of particular components. Well-known components, materials or methods are not necessarily described in great detail, in order to avoid obscuring the present disclosure. Any specific structural and functional details disclosed herein are not to be interpreted as limiting, but merely as a basis for the claims, and as a representative basis for teaching one skilled in the art to variously employ the invention.

Figure 1:
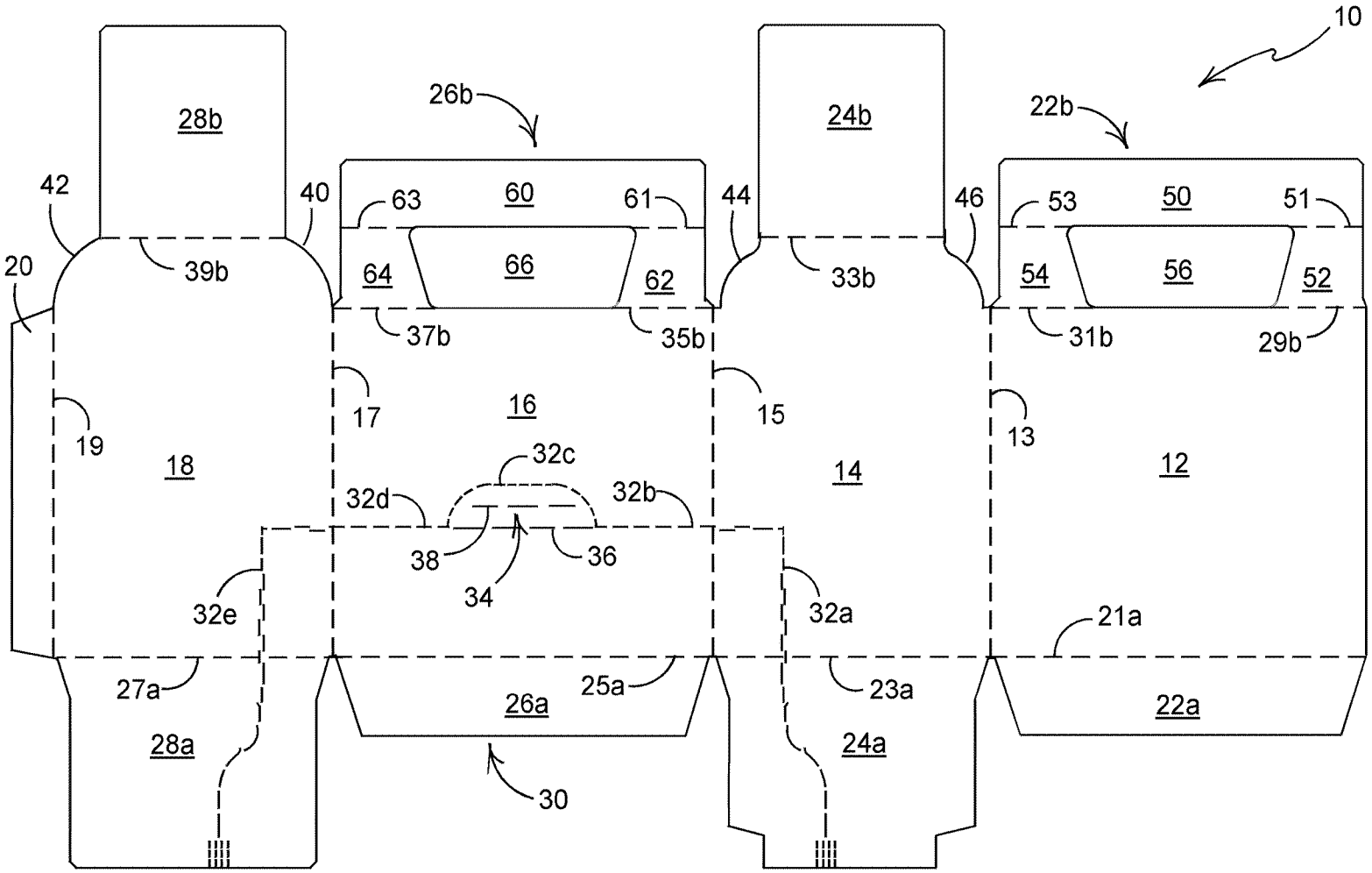
FIG. 1 is a plan view from above of a blank for forming carton according to a first embodiment of the invention.

Referring to FIG. 1, there is shown a perspective view of a blank 10 capable of forming a carton for packaging a plurality of primary products such as, but not limited to, bottles or cans, hereinafter referred to as "articles".

In the embodiments detailed herein, the terms "carton" and "carrier" refer, for the non-limiting purpose of illustrating the various features of the invention, to a container for engaging, carrying, and/or dispensing articles, such as cans or bottles. However, it is contemplated that the teachings of the invention can be applied to various containers, which may or may not be tapered and/or cylindrical. Other exemplary articles include bottles (for example metallic, glass or plastics bottles), cans (for example, aluminium cans), tins, pouches, packets and the like.

The blank is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, for example, to provide the carrier structure described in more detail below.

In the exemplary embodiment, the blank is configured to form a carton or carrier for packaging an exemplary arrangement of exemplary articles. For example, the arrangement is a matrix including rows and columns, such as a 2×3 arrangement of articles. The blank can be alternatively configured to form a carrier for packaging other articles and/or different arrangements of articles.

The blank 10 comprises a plurality of primary panels 12, 14, 16, 18 hinged one to the next in a linear series by fold lines 13, 15, 17 respectively. A first side panel 12 is hinged to top panel 14 by fold line 13; top panel 14 is hinged to a second side panel 16 by fold line 15; and second side panel 16 is hinged to bottom panel 18 by fold line 17. A securing flap 20 is hinged to bottom panel 18 by fold line 19.

Figure 2:
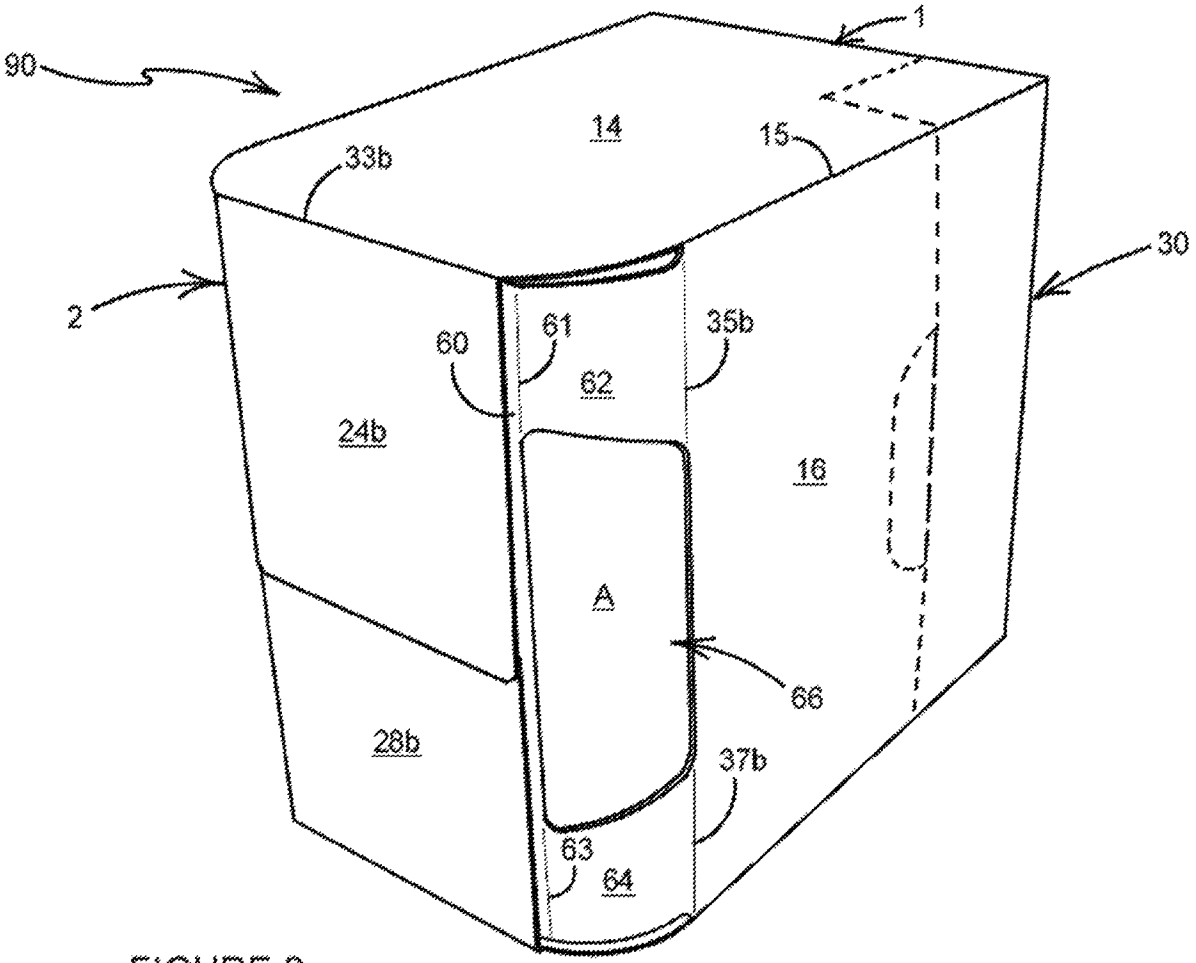
FIG. 2 is a perspective view from above of a carton formed from the blank of FIG. 1.
Figure 3:
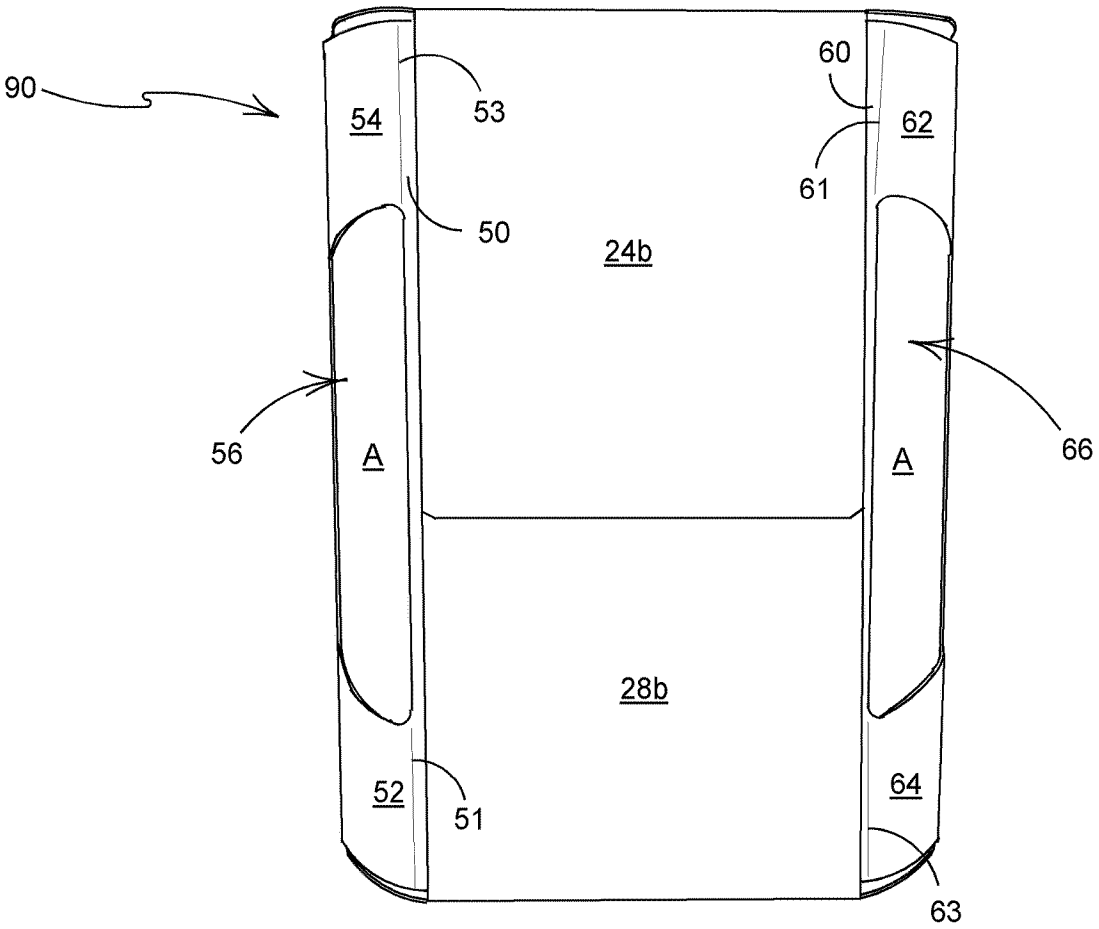
FIG. 3 is an end view of the carton of FIG. 2.

The primary panels 12, 14, 16, 18, when assembled into a carton as shown in FIG. 2, form a tubular structure having a rectangular cross section. The opposed ends of the tubular structure are closed at least in part by first and second end closure structures 1, 2 respectively. The first end closure structure 1 is provided by end flaps 22*a*, 24*a*, 26*a*, 28*a* while the second end closure structure 2 is provided by end flaps 22*b*, 24*b*, 26*b*, 28*b*. A first side end flap 22*a* is hinged to first side panel 12 by a fold line 21A; a second side end flap 26*a* is hinged to second side panel 16 by fold line 25*a*. A first top end flap 24*a* is hinged to top panel 14 by fold line 23*a*. A first bottom end flap 28*a* is hinged to bottom panel 18 by fold line 27*a*.

A third side end flap 22*b* is hinged to first side panel 12 by a pair of fold lines 29*b*, 31*b*, and a fourth side end flap 26*b* is hinged to the second side panel 16 by a pair of fold lines 35*b*, 37*b*.

A second top end flap 24*b* is hinged to top panel 14 by fold line 33*b*, and a second bottom end flap 28*b* is hinged to bottom panel 18 by fold line 39*b*.

The blank 10 comprises a weakened line of severance 32*a*, 32*b*, 32C, 32D, 32E, which forms a deployable access 30. A first portion 32*a* of the weakened line of severance 32*a*, 32*b*, 32C, 32D, 32E extends through the first top end flap 24*a* into the top panel 14; a second portion 32*b* of the weakened line of severance 32*a*, 32*b*, 32C, 32D, 32E extends from second side panel 16 into top panel 14 to meet the first portion 32*a* at its terminus. A third portion 32E of the weakened line of severance 32*a*, 32*b*, 32C, 32D, 32E extends through the second bottom end flap 28*a* into the bottom panel 18; a fourth portion 32D of the weakened line of severance 32*a*, 32*b*, 32C, 32D, 32E extends from second side panel 16 into bottom panel 18 to meet the third portion 32E at its terminus.

A fifth portion 32C is substantially U-shaped, and weakened line of severance 32*a*, 32*b*, 32C, 32D, 32E is defined within the second side panel 16. Fifth portion 32C extends between terminal ends of the second portion 32*b* and fourth portion 32D.

Fifth portion 32C defines in part a tab 34, which is coupled to the second side panel 16 by a first fold line 36. First fold line 36 is substantially co-linear with the second and fourth portions of weakened line of severance 32*a*, 32*b*, 32C, 32D, 32E. Fold line 36 extends between the ends of the U-shaped fifth portion 32C of the weakened line of severance 32*a*, 32*b*, 32C, 32D, 32E. A further fold line 38 is defined within the tab 34 and is disposed a parallel to first fold line 36.

When the blank 10 is assembled, the weakened line of severance 32*a*, 32*b*, 32C, 32D, 32E is continuous such that a corner of the carton can be removable to provide access to the carton's contents.

Bottom panel 18 comprises a pair of rounded corners 40, 42 at one end thereof. Each rounded corner 40, 42 defines a free edge of the bottom panel 18, which is separated from any other part of the blank 10 and is not directly joined to the same. The other end of the bottom panel 18 comprises square corners defined by adjacent fold lines 17, 19 which intersect orthogonally with fold line 27*a*.

Top panel 14 comprises a pair of rounded corners 44, 46 at one end thereof. Each rounded corner 44, 46 defines a free edge of the top panel 14 which is separated from any other part of the blank 10 and is not joined directly to any other part of the blank. The rounded corners 44, 46 of the top panel 14 have a smaller radius of curvature than the rounded corners of the bottom panel 18. The other end of the top panel 14 comprises square corners defined by adjacent fold lines 13, 15 which intersect orthogonally with fold line 23*a*.

The side end flap 22*b* comprises a first arm portion 52 hingedly connected to the first side panel 12 by a fold line 29*b*. Fold line 29*b* is orientated substantially perpendicularly to the fold line 13 hinging the first side panel 12 to the top panel 14. The side end flap 22*b* further comprises a second arm portion 54 hingedly connected to the first side panel 12 by a fold line 31*b*. Fold line 31*b* is orientated substantially perpendicularly to the fold line 13. The first arm portion 52 is hingedly connected to a first bridging portion 50 by a fold line 51. The second arm portion 54 is also hingedly connected to the first bridging portion 50 by a fold line 53. Fold line 51 is substantially parallel to fold line 29*b*. Fold line 53 is substantially parallel to fold line 31*b*. A display window 56 is defined in part by the first bridging portion 50, in part by the first side panel 12, in part by the first arm portion 52 and in part by the second arm portion 54. In the illustrated embodiment, the display window 56 is trapezoidal in shape. The display window 56 comprises a pair of converging edges. The converging edges converge towards the first side panel 12. The size of the display window 56 is large enough to allow the contents of the carton to be recognized by a consumer. For example, the maximum length of the display window 56 along the longer one of the parallel edges of the display window 56 is greater than one third of the height of the carton, e.g., the length of the side panel 12 along the fold line 21*a*.

The side end flap 26*b* comprises a third arm portion 62 hingedly connected to the side panel 16 by a fold line 35*b*. Fold line 35*b* is orientated substantially perpendicularly to the fold line 15 hinging the second side panel 16 to the top panel 14. The side end flap 26*b* further comprises a fourth arm portion 64 hingedly connected to the side panel 16 by a fold line 37*b*. Fold line 37*b* is orientated substantially perpendicularly to the fold line 17 hinging the second side panel 16 to the bottom panel 18. The third arm portion 62 is hingedly connected to a second bridging portion 60 by a fold line 61. The fourth arm portion 64 is also hingedly connected to the second bridging portion 60 by a fold line 63. Fold line 61 is substantially parallel to fold line 35*b*. Fold line 63 is substantially parallel to fold line 37*b*. A display window 66 is defined in part by the second bridging portion 60, in part by the second side panel 16, in part by the third arm portion 62 and in part by the fourth arm portion 64. In the illustrated embodiment the display window 66 is trapezoidal in shape. The display window 66 comprises a pair of parallel edges connected by a pair of converging edges which converge towards the second side panel 16. The size of the display window 66 is similar to that of the display window 56 discussed earlier. One of the parallel edges of the display window 66 which defines one of the opposed ends of the display window 66 is generally co-linear or aligned with the fold lines 61, 63 and extends alongside one of the side edges of each of the top and bottom end flaps 24*b*, 28*b*. The other parallel edge which defines the other end of the display window 66 is generally co-linear or aligned with the fold lines 35*b*, 37*b*. In an alternative embodiment, however, the fold lines 61, 63 may be generally aligned with the one side edge of each of the top and bottom end flaps 24*b*, 28*b*. In a further alternative embodiment, the fold lines 61, 63 may be positioned behind the top and bottom end flaps 24*b*, 28*d* such that they are hidden from view or not visible from the outside of the carton.

Turning to the construction of the carton 90 as illustrated in FIGS. 2, 3, 4 and 5, it is envisaged that the carton 90 can be formed by a series of sequential folding operations in a straight line machine, so that the carton 90 is not required to be rotated or inverted to complete its construction. The folding process is not limited to that described below and may be altered according to particular manufacturing requirements.

The bottom panel 18 is folded about fold line 17 to place the bottom panel 18 in overlaying relationship with the second side panel 16; as a consequence, the securing flap 20 is placed in overlaying relationship with the second side panel 16. Glue or other adhesive treatment is applied to the outside surface of the securing flap 20 or to the inside surface of a corresponding portion of the first side panel 12. The first side panel 12 is then folded about fold line 13 to place the first side panel 12 in overlaying relationship with the top panel 14. The free end portion of the first side panel 12 is brought into flat face contact with the securing flap 20 and is thereby secured thereto. Pressure may be applied to the first side panel 12 to ensure a secure bond between the first side panel 12 and the securing flap 20. In this way, a flat collapsed tubular structure is formed. This partially assembled blank may be transported or shipped to a conversion plant where it is converted into a carton 90.

In order to convert the partially assembled blank into a carton, the tubular structure must be erected. This can be achieved by engaging either a pair of adjacent ones of the primary panels 12, 14, 16, 18 or a pair of opposing ones of the primary panels 12, 14, 16, 18. In the case of engaging adjacent ones of the main panels 12, 14, 16, 18, the adjacent panels are unfolded with respect to one another about the fold line hinging them together. In the case of engaging opposing ones of the primary panels 12, 14, 16, 18, the opposing panels are separated from one another.

Once the partially assembled blank is erected into tubular structure, the carton 90 is loaded with substantially cylindrical articles, such as cans A, from one end of the tubular structure.

In alternative an embodiment, the carton may be loaded from both the ends. In order to facilitate loading of the articles A, one or more of the end flaps 22*a*, 22*b*, 24*a*, 24*b*, 26*a*, 26*b*, 28*a*, 28*b* may remain unfolded in the respective planes of the adjacent primary panels or may be folded outwardly so as to act as a funnel. Such a form of the half-erected carton can avoid interference with the articles A during the course of the articles loading.

Once loaded with the articles A, the ends of the tubular structure are closed by folding the end flaps 22*a*, 22*b*, 24*a*, 24*b*, 26*a*, 26*b*, 28*a*, 28*b*.

The first end of the tubular structure is closed by the first end closure structure 1 provided by the end flaps 22*a*, 24*a*, 26*a*, 28*a*. The first end closure structure 1 is formed by folding the side end flaps 22*a*, 26*a* to be substantially perpendicular to the first and second side panels 12, 16 to which they are hinged (or to be substantially perpendicular to the tubular axis of the tubular structure). The first top end flap 24*a* is folded to be substantially perpendicular to the top panel 14, and is secured with glue or other adhesive treatment to the first and second side end flaps 22*a*, 26*a*. The first bottom end flap 28*a* is folded to be substantially perpendicular to the bottom panel 18, and is secured with glue or other adhesive treatment to the first and second side end flaps 22*a*, 26*a*. By this means, all the end flaps of the first end closure structure are held in their respective folded/closing positions.

The second opposed end 2 of the tubular structure is closed by the second end closure structure 2 provided by the end flaps 22*b*, 24*b*, 26*b*, 28*b*. The second end closure structure is formed by folding or flexing the side end flaps 22*b*, 26*b* somewhat around the articles "A" adjacent respectively to the first and second side panels 12, 16. The first, second, third and fourth arm portions 52, 54, 62, 64 substantially conform to the shape of the articles "A" about which they are folded. In the illustrated embodiment, the article is substantially cylindrical and the arm portions 52, 54, 62, 64 take an arcuate or otherwise curved shape. In other embodiments, other shapes are envisaged. The first and second bridging portions 50, 60 are each folded about the respective fold lines 51/53, 61/63 such that the first and second bridging portions 50, 60 are disposed substantially orthogonally to the first or second side panel 12, 16. The second top end flap 24*b* is folded to be substantially perpendicular to the top panel 14, and is secured with glue or other adhesive treatment to the first and second bridging portions 50, 60. The second bottom end flap 28*b* is folded to be substantially perpendicular to the bottom panel 18, and is secured with glue or other adhesive treatment to the first and second bridging portions 50, 60 and to the second top end flap 24*b*. By this means, all the end flaps 22*b*, 24*b*, 26*b*, 28*b* of the second end closure structure are held in their respective folded/closing positions.

Figure 4:
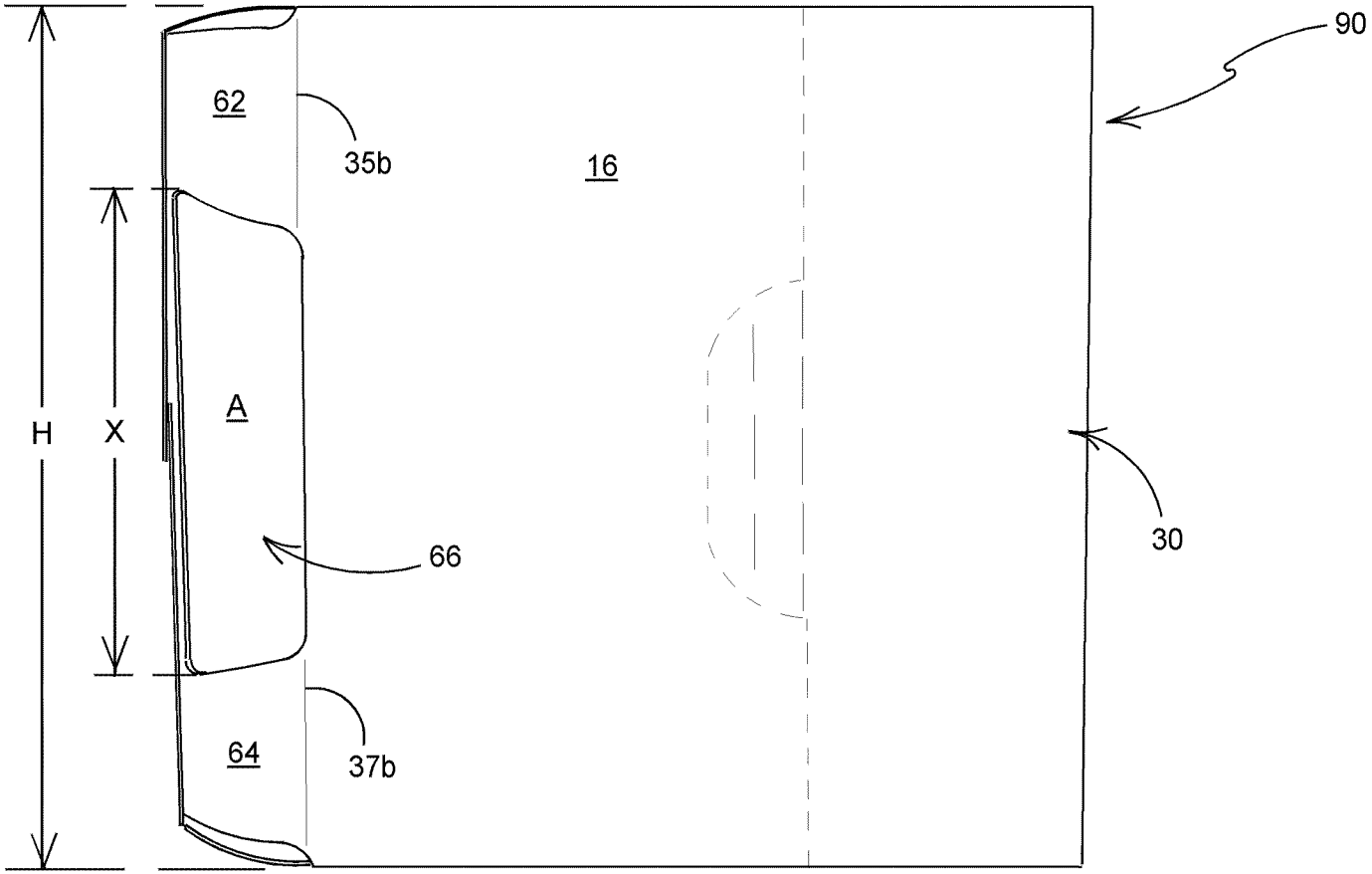
FIG. 4 is a side view of the carton of FIG. 2.
Figure 5:
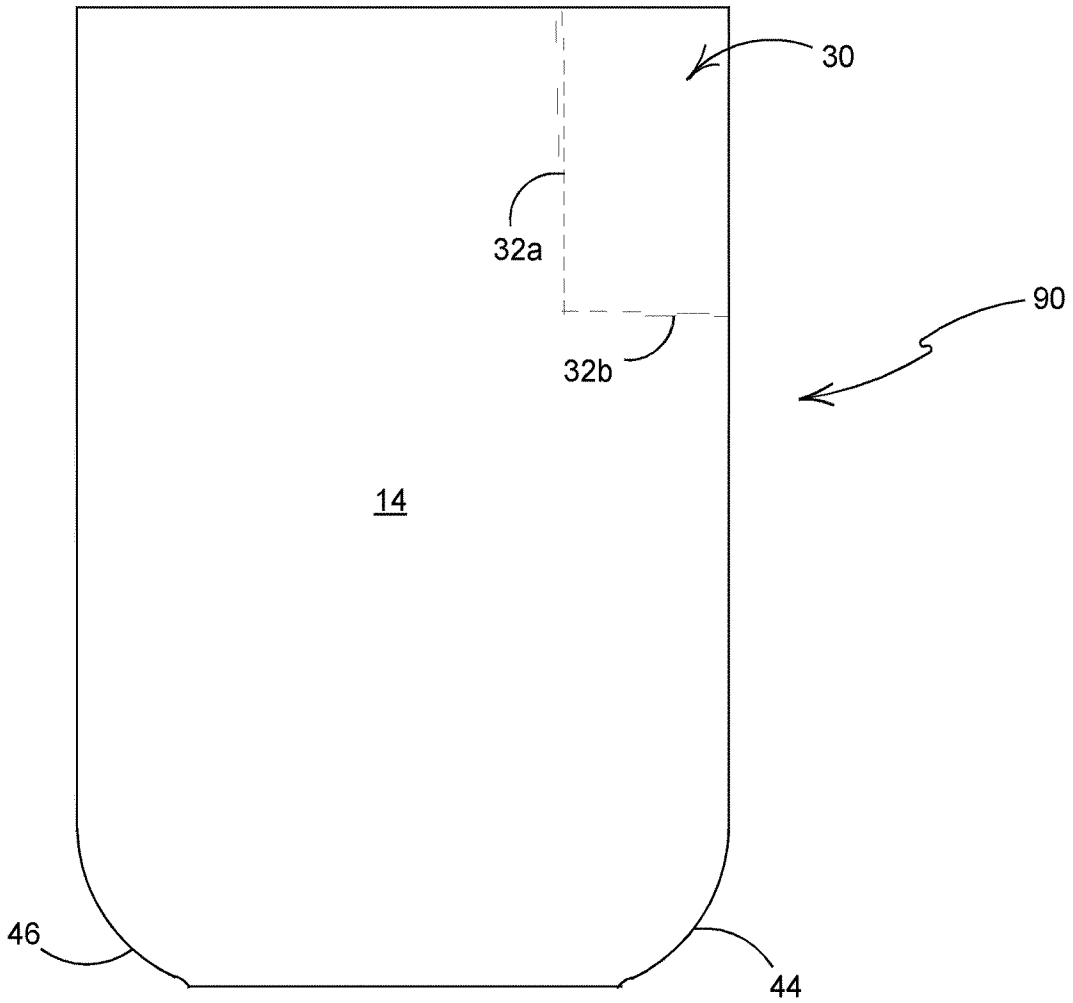
FIG. 5 is a top view of the carton of FIG. 2.

The display windows 56, 66 each form a display window through which a portion of the respective endmost article A can be viewed. In the illustrated embodiment of FIGS. 2 to 5, the bridging portions 50, 60 are disposed behind, or internally of, the top and bottom end flaps 24*b*, 28*b*. A portion of the bridging portions 50, 60 may be visible, that is to say, may not be covered by the top and bottom end flaps 24*b*, 28*b*. In other embodiments, the bridging portions 50, 60 may be fully covered by the top and bottom end flaps 24*b*, 28*b* such that the bridging portions 50, 60 are completely hidden from view. The display window comprises a height dimension X, which is greater than one third of the height H of the carton 90 and preferably one half of the height H, as best shown in FIG. 4.

Figures 6, 7, 8:
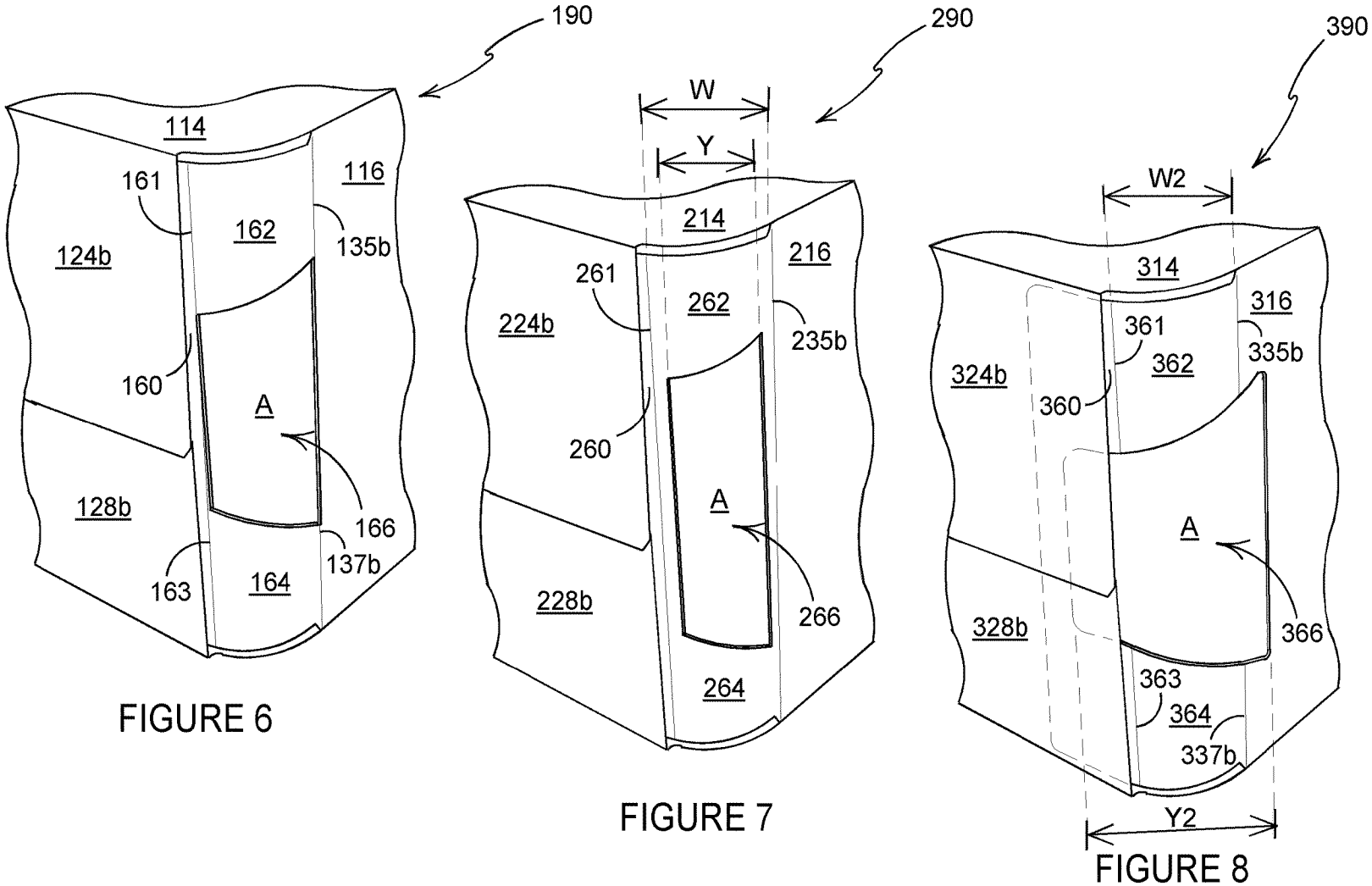
FIG. 6 is a perspective view from above of a portion of the carton according to a second embodiment of the invention.
FIG. 7 is a perspective view from above of a portion of the carton according to a third embodiment of the invention.
FIG. 8 is a perspective view from above of a portion of the carton according to a fourth embodiment of the invention.

Referring now to FIGS. 6, 7 and 8, there are shown alternative embodiments of the present invention. In the second, third and fourth illustrated embodiments like numerals have, where possible, been used to denote like parts, albeit with the addition of the prefix "100", "200" or "300" to indicate that these features belong to the second, third or fourth embodiments respectively. The alternative embodiments share many common features with the first embodiment, and therefore only the differences from the embodiment illustrated in FIGS. 1 to 5 will be described in any greater detail.

Referring to FIG. 6 showing the second embodiment of the invention, the carton 190 comprises a display window 166 defined in part by the arm portion 162, in part by the arm portion 164, in part by the second side panel 116 and in part by the second bridging portion 160. The display window 166 is trapezoidal in shape and comprises two parallel edges and two converging edges. The converging edges converge towards the top and bottom end flaps 124*b*, 128*b*. One of the parallel edges which defines one of the opposed ends of the display window 166 is co-linear or aligned with the fold lines 161, 163 which hingedly connect the bridging portion 160 to the arm portions 162, 164. The other parallel edge which defines the other end of the display window 166 is co-linear or aligned with the fold lines 135*b*, 137*b* which hingedly connect the side panel 116 to the arm portions 162, 164. As such, the display window 166 extends between fold lines 161 and 135*b*.

FIG. 7 illustrates a corner portion of a carton 290 according to the third embodiment of the invention. The carton 290 comprises a display window 266 defined fully within the area between the fold lines 261, 235*b*. The display window 266 is trapezoidal in shape, and comprises two parallel edges and two converging edges. The converging edges converge towards the top and bottom end flaps 224*b*, 228*b*. One of the parallel edges which defines one of the opposed ends of the display window 266 is parallel with and spaced apart from the single fold line 261 which hingedly connects the bridging portion 260 to the arm portions 262, 264. Stated differently, the one of the opposed ends of the display window 266 is offset from the fold line 261 in the direction toward the other end of the display window 266. The other parallel edge which defines the other end of the display window 266 is parallel with and spaced apart from the single fold line 235*b* which hingedly connects the side panel 216 to the arm portions 262, 264. Stated differently, the other end of the display window 266 is offset from the fold line 235*b* in the direction toward the one end of the display window 266. The maximum width Y spanning the display window 266 from end to end is less than the distance W between the fold lines 261, 235*b*, i.e., the horizontal length of each arm portion 262, 264.

FIG. 8 illustrates a corner portion of a carton 390 according to the fourth embodiment of the invention. The carton 390 comprises a display window 366 that extends into the adjacent side panel 316 and to the adjacent bridging portion 360. Stated differently, the display window 366 is struck in part from the side panel 316 and in part from the bridging portion 360. The display window 366 is trapezoidal in shape, and comprises two parallel edges and two converging edges. The converging edges converge towards the top and bottom end flaps 324*b*, 328*b*. One of the parallel edges which defines one of the opposed ends of the display window 366 is provided by the bridging portion 360, parallel with and spaced apart from the fold lines 361, 363 which hingedly connect the bridging portion 360 to the arm portions 362, 364. Stated differently, the one of the opposed ends of the display window 366 is offset from the fold lines 361, 363 in the direction away from the other end of the display window 366. The other parallel edge which defines the other end of the display window 366 is provided by the side panel 316, parallel with and spaced apart from fold lines 335*b*, 337*b* which hingedly connect the side panel 316 to the arm portions 362, 364. Stated differently, the other end of the display window 366 is offset from the fold lines 335*b*, 337*b* in the direction away from the one end of the display window 366. The maximum width Y2 spanning the display window 366 from end to end is greater than the distance W2 between the fold lines 361 and 335*b* (or the distance between the fold lines 363 and 337*b*) where "W" also refers to the horizontal length of each of the arm portions 362, 364. A portion of the display window 366 is disposed behind, or covered by, the top and bottom end flaps 324*b*, 328*b*.

It can be appreciated that various changes may be made within the scope of the present invention. For example, the size and shape of the panels and display windows may be adjusted to accommodate articles of differing size or shape.

It will be recognised that as used herein, directional references such as "top", "bottom", "front", "back", "end", "side", "inner", "outer", "upper" and "lower" do not limit the respective panels to such orientation, but merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. A fold line is typically a scored line, an embossed line, or a debossed line. Any reference to "hinged connection" or "fold line" should not be construed as necessarily referring to a single fold line only; indeed it is envisaged that hinged connection can be formed from any one or more of the following, a short slit, a frangible line or a fold line without departing from the scope of the invention.

As used herein, the term "severance line" refers to all manner of lines that facilitate separating portions of the substrate from one another, or that indicate optimal separation locations. Severance lines may be frangible or otherwise weakened lines, tear lines, cut lines, or slits.

It should be understood that hinged connection, severance lines and fold lines can each include elements that are formed in the substrate of the blank including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The invention claimed is:

1. A carton for packaging one or more primary product containers comprising a plurality of primary panels hingedly interconnected to form a tubular structure and an end closure structure which at least partially closes one of the opposed ends of the tubular structure, wherein the primary panels include a first wall panel and a second wall panel, the end closure structure comprises a first end flap connected to the first wall panel and a second end flap connected to the second wall panel, the first end flap comprises:

at least two arm portions each hingedly connected at a respective first end thereof to the first wall panel and extending to a respective second end thereof; and a bridging portion connected to the second ends of the arm portions and extending between the arm portions, wherein the at least two arm portions are spaced apart from each other with a display window therebetween such that a portion of at least one of the primary product containers in the carton is exposed to view through the display window, the display window being defined, at least in part, between the at least two arm portions, and wherein the bridging portion is secured to the second end flap to retain the first and second end flaps in respective closing positions where the first and second end flaps at least partially close the one of the opposed ends of the tubular structure;

wherein the at least two arm portions define a corner of the carton and wherein the at least two arm portions deform to at least partially follow the contour or shape of the at least one of the primary product containers in the carton that is adjacent thereto.

2. A carton according to claim 1, wherein the bridging portion is hingedly connected to the at least two arm portions along at least one fold line which extends substantially parallel to at least one fold line between the first wall panel and the at least two arm portions.

3. A carton according to claim 1 wherein the display window has a maximum vertical length and the carton has a maximum vertical length, the maximum vertical length of the display window being no less than one third of the maximum vertical length of the carton.

4. A carton according to claim 1 wherein the bridging portion is covered at least in part by the second end flap so that the bridging portion is concealed at least partially from view.

5. A carton according to claim 1 wherein the at least two arm portions and the bridging portion are connected by at least one fold line which is disposed behind the second end flap.

6. A carton according to claim 1 wherein the at least two arm portions and the bridging portion are connected by at least one fold line which is generally aligned with a side edge of the second end flap.

7. A carton according to claim 1 wherein a portion of the bridging portion is covered by the second end flap so that the bridging portion is partially exposed to view.

8. A carton according to claim 1 wherein the at least two arm portions and the bridging portion are connected by at least one fold line, and wherein one of the opposed ends of the display window is generally aligned with the at least one fold line.

9. A carton according to claim 1 wherein the at least two arm portions and the bridging portion are connected by at least one fold line, and wherein one of the opposed ends of the display window is offset from the at least one fold line.

10. A carton according to claim 9 wherein the one of the opposed ends of the display window is offset from the at least one fold line in a direction toward the other end of the display window.

11. A carton according to claim 9 wherein the one of the opposed ends of the display window is offset from the at least one fold line in a direction away from the other end of the display window.

12. A carton according to claim 11 wherein a portion of the display window is covered by the second end flap.

13. A carton according to claim 1 wherein the display window extends into the first wall panel.

14. A carton according to claim 1 wherein the at least two arm portions and the first wall panel are connected by at least one fold line, wherein one of the opposed ends of the display window is generally aligned with the at least one fold line.

15. A carton according to claim 1 wherein the at least two arm portions and the first wall panel are connected by at least one fold line, wherein one of the opposed ends of the display window is offset from the at least one fold line.

16. A carton according to claim 15 wherein the one of the opposed ends of the display window is offset from the at least one fold line in a direction toward the other end of the display window.

17. A carton according to claim 15 wherein the one of the opposed ends of the display window is offset from the at least one fold line in a direction away from the other end of the display window.

18. A blank for forming a carton comprising a plurality of panels for forming walls of a tubular structure and end flaps for at least partially closing one of the opposed ends of the tubular structure, wherein the plurality of panels include a first wall panel and a second wall panel, wherein the end flap include a first end flap connected to the first wall panel and a second end flap connected to the second wall panel and wherein the first end flap comprises:

at least two arm portions each hingedly connected at a respective first end thereof to the first wall panel and extending to a respective second end thereof; and a bridging portion connected to the second ends of the arm portions and extending between the arm portions, wherein the at least two arm portions are spaced apart from each other with a display window therebetween such that a portion of a primary product container to be placed in a set-up carton formed from the blank is exposed to view through the display window, the display window being defined, at least in part, between the at least two arm portions, and wherein the bridging portion is secured to the second end flap when the blank is erected into the set-up carton so as to retain the first and second end flaps in respective closing positions where the first and second end flaps at least partially close the one of the opposed ends of the tubular structure;

wherein the at least two arm portions define a corner of the set-up carton and wherein the at least two arm portions deform to at least partially follow the contour or shape of the primary product container when it is placed in the set-up carton.

19. A blank according to claim 18, wherein the bridging portion is hingedly connected to the at least two arm portions along at least one fold line which extends substantially parallel to at least one fold line between the first wall panel and the at least two arm portions.

20. A blank according to claim 18 wherein the first wall panel is hingedly connected to the at least two arm portions along at least one fold line, the first wall panel has a length along the at least one fold line, the display window has a length along the at least one fold line, and the length of the display window is no less than one third of the length of the first wall.

* * * * *